US005112268A

United States Patent [19]

Klaus

[11] Patent Number: 5,112,268

[45] Date of Patent: May 12, 1992

[54] BEADS AND WIRE FRAME TOY

[76] Inventor: Kathy Klaus, 169 Aspen Heights 23330 Rd. 522, Sherwood Park, T8B 1H8 Alberta, Canada

[21] Appl. No.: 694,408

[22] Filed: May 1, 1991

[51] Int. Cl.[5] ..... A63H 33/00

[52] U.S. Cl. ..... 446/489; 434/258; D19/59

[58] Field of Search ..... 446/489, 227, 491, 242, 446/236, 419; 434/258, 203, 204; D21/65; D19/59; 273/441

[56] References Cited

U.S. PATENT DOCUMENTS

| | | | |
|---|---|---|---|
| D. 265,666 | 8/1982 | Nakao et al. | D21/65 |
| 1,099,009 | 6/1914 | Bennett | 434/203 |
| 3,254,443 | 6/1966 | Olson | 446/450 |
| 4,915,666 | 4/1990 | Maleyko | 446/242 |

FOREIGN PATENT DOCUMENTS

| | | | |
|---|---|---|---|
| 2038067 | 7/1980 | United Kingdom | 273/441 |

*Primary Examiner*—Mickey Yu
*Attorney, Agent, or Firm*—Burke-Robertson

[57] ABSTRACT

A toy comprising a frame formed from a continuous length of rigid elongated wire having ends. The wire between its ends is bent to form multiple curves to give the frame a three dimensional configuration with top, bottom and sides. The curves of the wire at the bottom lie in a plane to form a flat supporting surface for the frame. A plurality of beads, with a hole in each bead are movably supported on the wire, with the wire passing through each hole. The holes are sufficiently large to permit the beads to freely slide over the curves of the wire between its ends. In alternative embodiments, stop means may be provided at the ends of the wire to hold the beads on the wire or the ends of the wire may be joined by appropriate means, in each case to provide a continuous, endless run for the beads over the entire frame.

15 Claims, 1 Drawing Sheet

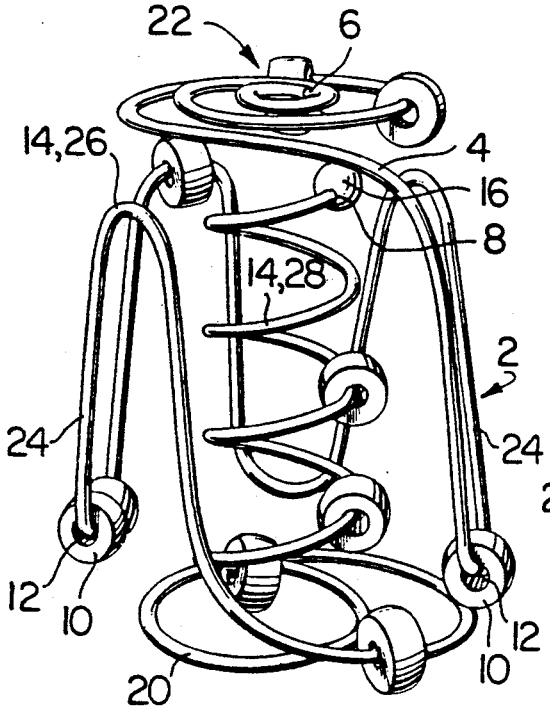
FIG. 1
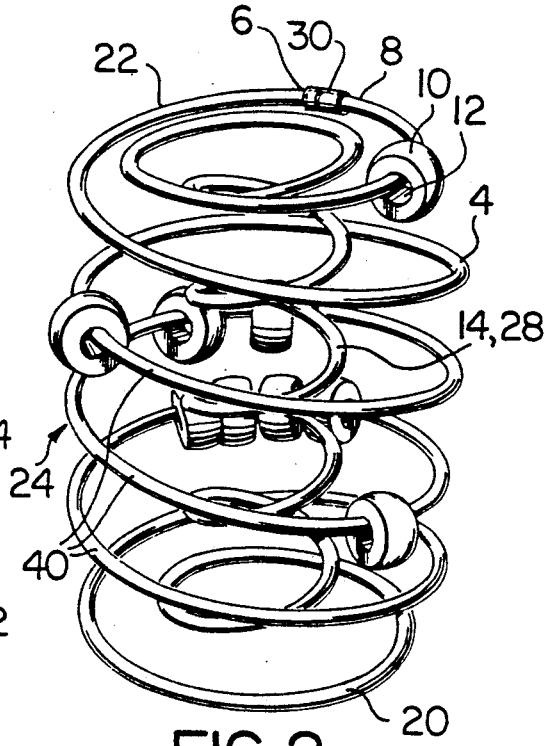
FIG. 2
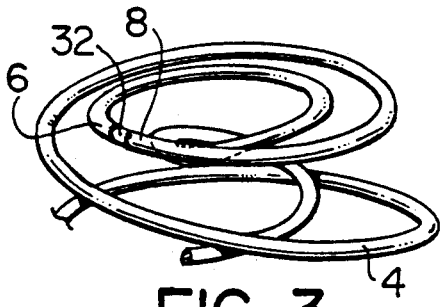
FIG. 3
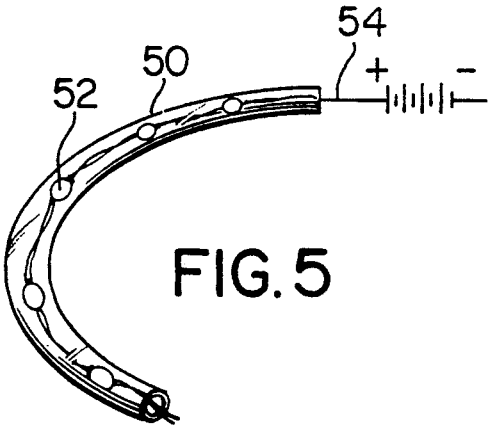
FIG. 5
FIG. 4
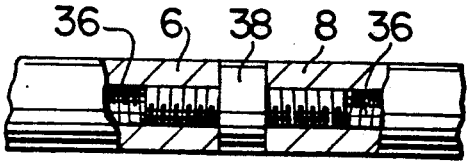

BEADS AND WIRE FRAME TOY

BACKGROUND OF THE INVENTION

The present invention relates to an educational and developmental toy, and more particularly to such a toy of the type which forms a wire maze which is strung with blocks or beads.

Toys of the type comprising wire mazes strung with wooden blocks or beads are used to strengthen young hands and develop motor skills in children. Such toys have been manufactured and sold for several years. These toys essentially consist of a wooden base on which are mounted the two ends of rigid wires bent into interesting shapes. These wires carry free moving, brightly coloured beads. A number of different wires, usually of different colours, are placed on the base with their ends at different locations on the base. They provide opportunity for fun play for the children, who can move the beads into different patterns, exercising their counting ability, strategic thinking, spacial awareness and physical dexterity. They may be used in conjunction with a teacher or parent to assist in the development of language skills (e.g. "top", "bottom", "middle", "over", "under", "left", "right", "through", "up", "down", etcetera). When the wires and beads are of multiple colours and the beads are of different shapes, they can be used to teach colour and shape recognition.

The conventional construction of these toys with multiple wires on a wooden base, while admirably suited to achieve the intended purpose, is relatively complicated and expensive. It is thus an object of the present invention to provide a toy of the wire maze type which is of a simpler, more economical construction.

SUMMARY OF THE INVENTION

In accordance with the present invention there is provided a toy, which comprises a frame formed from a continuous length of rigid elongated wire having ends. The wire between its ends is bent to form multiple curves to give the frame a three dimensional configuration with top, bottom and sides. The curves of the wire at the bottom lie in a plane to form a flat supporting surface for the frame. A plurality of beads, with a hole in each bead are movably supported on the wire, with the wire passing through each hole. The holes are sufficiently large to permit the beads to freely slide over the curves of the wire between its ends.

In alternative embodiments of the present invention, stop means may be provided at the ends of the wire to hold the beads on the wire or the ends of the wire may be joined by appropriate means, in each case to provide a continuous, endless run for the beads over the entire frame.

The use of a single, continuous length of rigid wire to form both the wire maze itself and the base avoids the need for a base of wood or other material This significantly reduces the complexity and cost of construction of the toy. The single wire construction nevertheless provides most of the same features and advantages of the conventional, wood based wire maze devices from the standpoint of education and development of a child.

BRIEF DESCRIPTION OF THE DRAWINGS

These and other objects and advantages of the invention will become apparent upon reading the following detailed description and upon referring to the drawings in which:

FIG. 1 is a perspective view of a wire maze toy in accordance with the present invention;

FIG. 2 is a perspective view of an alternative embodiment of wire maze toy in accordance with the present invention, in which the wire ends are joined;

FIGS. 3 and 4 are fragmentary views illustrating FIG. 4 in partial section or alternative methods of joining the wire ends for the embodiment of FIG. 2;

FIG. 5 is a fragmentary schematic view of an alternative construction of a wire maze toy in accordance with the present invention, incorporating lights.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning to FIG. 1 there is illustrated a wire maze toy 2 in accordance with the present invention comprising a continuous length of rigid, elongated wire 4, preferably of circular cross-section and having ends 6 and 8. Between ends 6 and 8 and slidable on wire 4 are a plurality of beads 10 having an enlarged aperture or hole 12 through which that wire passes. It is preferred that beads 10 be of multiple colours. While illustrated as being of generally annular shape, it is within the scope of the present invention that these beads be of any other desired shape so long as they freely slide over the curves of wire 4. Wire 4 is curved, between its ends, with varying shaped curves 14, to form a frame on which beads 10 sit and over which they can be moved between the ends of the wire. Holes 12 are preferably of circular configuration and of sufficient size to permit the beads to freely slide over the curves 14 of wire 4 between its ends 6 and 8. To prevent beads 10 from sliding off of wire 4, to end 8 is secured an enlarged bead 16 to act as a stop. The other end 6 is curved into itself as illustrated to provide the same function. In the illustrated embodiment, curves 14 at the bottom 20 form a spiral lying in a plane, forming a flat supporting surface for the device. In this manner, the conventional wood base of prior known wire maze toys is avoided. Similarly, at the top 22, wire 4 is curved to form a spiral again lying in a plane parallel to that of bottom 20. This permits the device to be supported on its top, as well, merely by reversing the orientation of the device. In FIG. 1, sides 24 between bottom 20 and top 22 are formed from upwardly and downwardly undulating curves 26, as illustrated, those curves having a generally cylindrical conformation. The wire 4 also extends upwardly, in spiral curves 28, those curves lying in a cylindrical conformation, inwardly spaced from but concentric with the outer cylindrical conformation formed by sides 24. In this manner, an interesting and practical wire maze toy 2 is provided.

An alternative construction of wire maze toy 2 is illustrated in FIG. 2, in which ends 6 and 8 are confronting and in fact joined to provide a continuous, endless run of wire 4 for beads 10. These ends are joined by means of a piece of tubing 30 secured to each of these ends and extending between them. Alternatively, as illustrated in FIG. 3, ends 6 and 8 may be secured together by spot welding 32 or, as illustrated in FIG. 4, they may be provided with internally threaded holes 36 of opposite thread, into which an appropriate double-sided screw 38, with opposite threads on either side, may be used as illustrated. In this way, a continuous frame in which the beads can travel. In this illustrated embodiment, sides 24 are formed by spirals 40 lying in a cylindrical configuration. Again, a flat bottom 20 is provided at one end, as a base, and a flat top 22 is provided, at the other end, bottom 20 and top 22 being formed by spirals lying in parallel planes.

While toy 2 will normally be made from metal or plastic wire, it is also envisaged that wire 4 may be of hollow, tubular construction 50, as illustrated in FIG. 5. In this embodiment, it is possible to put lights 52, with appropriate circuitry 54 extending to the lights from a power source 56, so that the wire may be internally illuminated as desired. Tubing 50 would of course be of rigid construction.

Thus it is apparent that there has been provided in accordance with the invention a toy that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A toy comprising a frame formed from a continuous length of rigid elongated wire having ends, the wire between its ends being bent to form multiple curves to give the frame a three dimensional configuration with top, bottom and sides, the curves of the wire at the bottom lying in a plane to form a flat supporting surface for the frame; a plurality of beads, with a hole in each bead, movably supported on the wire, with the wire passing through each hole, the holes being sufficiently large to permit the beads to freely slide over the curves of the wire between its ends.

2. A toy according to claim 1 wherein stop means are provided at the ends of the wires to hold the beads on the wire.

3. A toy according to claim 2 wherein the wire is of circular cross-section.

4. A toy according to claim 1 wherein the sides are formed from undulating curves extending between the top and bottom and lying in a cylindrical configuration.

5. A toy according to claim 1 wherein the sides are formed from a continuous spiral extending between the top and bottom and lying in a cylindrical configuration.

6. A toy according to claim 4 wherein the top and bottom of the frame are planar and formed from spiral curves of the wire.

7. A toy according to claim 5 wherein the top and bottom of the frame are planar and formed from spiral curves of the wire.

8. A toy according to claim 6 further provided with an inner spirally curved portion of the wire formed from spiral curves lying in a cylindrical configuration, extending between the top and bottom.

9. A toy according to claim 7 further provided with an inner spirally curved portion of the wire formed from spiral curves lying in a cylindrical configuration, extending between the top and bottom.

10. A toy according to claim 1 wherein means are provided to join the ends of the wire to form a continuous, endless run for the beads over the entire frame.

11. A toy according to claim 10 wherein the ends of the wire are jointed together by spot welding.

12. A toy according to claim 10 wherein tubing extends between the ends of the wire.

13. A toy according to claim 10 wherein the ends of the wire are provided confronting openings with internal screw threads of opposite screw configuration, and are joined together by double ended screw means of appropriate screw thread configuration at each end.

14. A toy according to claim 1 wherein the elongated wire is of tubular construction.

15. A toy according to claim 14 wherein the tubular wire is transparent and power actuated light means are provided within it, spaced along its length, and the toy is further provided with circuitry associated with the power means to illuminate the light means as required.

* * * * *